United States Patent [19]

Fox

[11] 4,423,116

[45] Dec. 27, 1983

[54] REUSABLE PROJECTION TRANSPARENCY

[75] Inventor: Richard E. Fox, Dayton, Ohio

[73] Assignee: Appleton Papers Inc., Appleton, Wis.

[21] Appl. No.: 358,165

[22] Filed: Mar. 15, 1982

[51] Int. Cl.[3] ..... B41M 5/18

[52] U.S. Cl. ..... 428/411; 282/27.5; 427/151; 428/913

[58] Field of Search ..... 282/27.5; 427/150, 151; 428/320.4, 320.6, 320.8, 488, 480, 913, 914, 411

[56] References Cited

U.S. PATENT DOCUMENTS 4,025,090 5/1977 Petitpierre ..... 282/27.5

4,028,118 6/1977 Nakasuji et al. ..... 106/21

*Primary Examiner*—Bruce H. Hess

*Attorney, Agent, or Firm*—E. Frank McKinney; Paul S. Phillips, Jr.

[57] ABSTRACT

A thermally-responsive transparent film is disclosed which comprises certain chromogenic material and certain color developer material. With this film marks are developed in response to the application of heat to form an image. These images can be erased by the action of certain liquids or vapors. The imaged and erased states are fixed under a range of environmental conditions. This film finds particular utility as a reusable projection transparency.

12 Claims, No Drawings

REUSABLE PROJECTION TRANSPARENCY

This invention pertains to record media on which marks are developed in response to an application of heat or certain liquids or vapors. It more particularly relates to such record media in the form of transparencies wherein marks are developed in response to the application of heat and erased by the action of certain liquids or vapors.

The invention particularly concerns reusable record material capable of copying a wide range of document types by means of a thermal reflex copying process.

Reversible imaging capability has been disclosed in U.S. Pat. Nos. 3,414,423, 3,515,568, 3,560,229, 3,666,525 and 4,028,118 and Japanese Patent Disclosure No. 78-102284.

The images produced in U.S. Pat. No. 4,028,118 and Japanese Disclosure No. 78-102284 vary with temperature. Since these references do not relate to fixed images they do not disclose or suggest the reversible fixed images of the present invention.

U.S. Pat. No. 3,560,229 suggests a method in which the appearance, disappearance and/or permanency of a color developable from a composition can be controlled in the presence of heat or water, by the inclusion of a predetermined organic solvent in the colorforming composition (Column 1, lines 64–68). The required organic solvent may be a glycol, a glycol ether, a halogenated biphenyl or biphenyl ether, an aromatic or aliphatic ester type plasticizer, and other solvent media of low vapor pressure.

U.S. Pat. No. 3,666,525 discloses a heat-sensitive copying sheet comprising crystal violet lactone, gallic acid, acetanilide, a styrene-butadene copolymer and toluene. The image produced from this sheet is observed to disappear upon contact with water (Column 8, lines 52–61). The heat-sensitive composition of this disclosure requires the presence of a thermofusible material.

U.S. Pat. Nos. 3,414,423 and 3,515,568 relate to methods for erasing an image from thermographic copying materials to make the material reusable. In these methods a colored complex of a p-quinone compound and a dihydroxybenzene compound is erased by the application of certain organic solvents or heat.

Manifold set employing lactone chromogenous compounds and phloroglucinol co-reactant have been disclosed in U.S. Pat. No. 3,244,548.

Demand for projection transparencies is high and annual consumption of such material is great. Because of this great annual usage of projection transparencies, a product which could be reused would produce beneficial effects on consumption of non-renewable resources and on supply expenditures.

The present invention is concerned with a reversibly thermally-responsive transparent film material which finds its principal use as a projection transparency. Such a material depends upon reversible erasure of heat-developed images, rendering the material reusable a substantial number of times. Such material has a broad thermal lattitude relative to commercially available projection transparencies. That is, the material of the present invention is capable of copying a wide range of document types at a single temperature setting on a heat-sensitive copying machine.

It is an object of the present invention to provide a projection transparency which is imaged by the selected application of heat.

It is also an object of this invention to provide a projection transparency which, once imaged, can be erased by the application of certain liquids or vapors.

It is another object of this invention to provide a projection transparency which, once imaged and erased, can be re-imaged by the selected application of heat.

It is yet another object of this invention to provide a projection transparency which is capable of alternately undergoing the imaging and erasing steps a substantial number of times.

It is still another object of this invention to provide a projection transparency which has a broad thermal lattitude.

Other objects, aspects and advantages of this invention will be apparent to one skilled in the art from the following disclosure and appended claims.

The thermally-responsive transparent film material of this invention comprises an optically clear substrate, upon which is coated a homogeneous solid solution (functional layer) comprising chromogenic material, color developer material and a suitable transparent binder. A protective layer comprising a suitable transparent film may be applied over the top of the functional layer. Images are generated on the film material in response to an application of heat. The thermally-produced image can be erased by the deliberate exposure of the film to water or water vapor. This erased film can then be reimaged by the application of heat. These imaging and erasing steps can be repeated a substantial number of times. The film is fixed in either state, imaged or erased, until the deliberate application of the next step in the cycle. The image consists of a dark mark on either a colorless background or a lighter colored background which can be the same or different from the color of the image.

The transparent substrate employed in this invention can vary widely but is preferably a transparent polymeric film material. Exemplary of such polymeric film material is polyester film.

The functional layer utilized in this invention is a transparent homogeneous solid solution comprising chromogenic material, color developer material and a suitable transparent binder.

The preferred chromogenic compounds useful in this invention are crystal violet lactone, 3,3-bis(p-dimethylaminophenyl)phthalide, 3,3-bis(1-ethyl-2-methylindol-3-yl)phthalide, 3-(1-ethyl-2-methylindol-3-yl)-3-(4-diethylamino-2-ethoxyphenyl)phthalide, a mixture of the isomers 5-(1-ethyl-2-methylindol-3-yl)-5-(4-dimethylamino-2-ethoxyphenyl)-5,7-dihydrofuro[3,4-b]pyridin-7-one and 7-(1-ethyl-2-methylindol-3-yl)-7-(4-diethylamino-2-ethoxyphenyl)-5,7-dihydrofuro[3,4-b]pyridin-5-one, a mixture of the isomers 5-(1,2-dimethylindol-3-yl)-5-(4-dimethylaminophenyl)-5,7-dihydrofuro[3,4-b]pyridin-7-one and 7-(1,2-dimethylindol-3-yl)-7-(4-dimethylaminophenyl)-5,7-dihydrofuro[3,4-b]pyridin-5-one, 6-diethylamino-2-(N-heptanoylamino)-fluoran, 6-diethylamino-2-butoxyfluoran, 2-chloro-6-diethylamino-3-methylfluoran, 6-diethylamino-1,3,4-trimethylfluoran, 6-cyclohexylamino-2-methylfluoran, 9-diethylamino-spiro[12H-benzo(a)xanthene-12,1′(3′H)isobenzofuran-3′-one], 3′,6′-diethylamino-spiro[1H-2-N-acetylisoindole-3-one-1,9′-xanthene], 3′,6′-diethylamino-spiro[1,2-benz-2-N-ethyl-1,1-dioxyisothiazoline-3,9'-xanthene], bis(4,4'-diethylaminophenyl)ketone, N-Benzoylauramine, 1-(4-dimethylaminophenyl)-2-(quinolin-4-yl)ethylene, 1-phenyl-1-p-dimethylaminophenyl-6-dimethylamino-3-oxo-isochroman, bis(4,4'-diethylaminophenyl)phenyliminomethane, 4-(p-ethoxyphenylazo)-m-phenylenediamine, 5',5''-dibromo-o-cresol-sulfonephthalein, 3-(1-ethyl-2-methylindol-3-yl)-3-(4-diethylamino-2-butoxyphenyl)phthalide and 6-diethylamino-2-dibenzylaminofluoran;

More preferred among the chromogenic compounds found useful in this invention are crystal violet lactone, 6-cyclohexylamino-2-methylfluoran, 2-chloro-6-diethylamino-3-methylfluoran, 6-diethylamino-1,3,4-trimethylfluoran, 3-(1-ethyl-2-methylindol-3-yl)-3-(4-diethylamino-2-butoxyphenyl)phthalide, 3,3-bis(1-ethyl-2-methylindol-3-yl)phthalide, 9-diethylamino-spiro[12H-benzo(a)xanthene-12,1'(3'H)isobenzofuran-3'-one], 6-diethylamino-2-dibenzylaminofluoran and a mixture of the isomers 5-(1-ethyl-2-methylindol-3-yl)-5-(4-dimethylamino-2-ethoxyphenyl)-5,7-dihydrofuro[3,4-b]pyridin-7-one and 7-(1-ethyl-2-methylindol-3-yl)-7-(4-dimethylamino-2-ethoxyphenyl)-5,7-dihydrofuro[3,4-b]pyridine-5-one.

Most preferred among the chromogenic compounds found useful in this invention is crystal violet lactone.

The preferred color developer materials useful in this invention are phloroglucinol, 2',4',6'-trihydroxyacetophenone, and gallic acid.

More preferred among the color developer materials found useful in this invention are phloroglucinol and gallic acid.

Most preferred among the color developer materials found useful in this invention is phloroglucinol.

Transparent binders useful in this invention are cellulose acetate, cellulose acetate propionate, ethyl cellulose, acrylic ester resins and hydroxypropyl cellulose.

Most preferred among the transparent binders useful in this invention is cellulose acetate.

In order to obtain the functional layer in the form of a homogeneous solid solution, the layer must be applied from a solution of the components in a common solvent or mixture of solvents. The choice of these solvents can be determined without undue experimentation and does not affect the scope of the present invention.

The protective layer optionally applied from solution over the functional layer may be any suitable transparent film material compatible with the functional layer reaction. Exemplary of such transparent film material is polystyrene or chlorined rubber.

The thermal imaging of this invention may be accomplished by any means which subjects the film to heat in localized areas corresponding to the desired image pattern. Exemplary of such means are reflex thermal copy machines, heated styli and thermal printers. The erasure of the thermally-produced images can be accomplished by any means which subjects the functional coating of the imaged film to an atmosphere of very high relative humidity, preferably at an elevated temperature. Exemplary of such methods is the storage of the imaged film for several minutes in a storage chamber maintained at 100% RH, by passing the imaged film in contact with a moist surface (e.g. a water-saturated cloth or paper) through a reflux thermal copy machine or by immersion of the imaged film in water.

The following examples are given merely as illustrative of the present invention and are not to be considered as limiting. All percentages and parts throughout the application are by weight unless otherwise specified.

EXAMPLE 1

A solvent mixture of the following composition is prepared:

| Solvent Mixture A | |
|---|---|
| Solvent | Weight Percent |
| Ethanol (denatured) | 29.3 |
| Ethyl Acetate | 21.9 |
| Acetone | 19.3 |
| Toluene | 15.9 |
| 2-ethoxyethyl acetate | 13.6 |

A functional coating solution is prepared by dissolving 0.35 parts crystal violet lactone, 1.3 parts phloroglucinol dihydrate and 1.35 parts cellulose acetate in 97 parts of solvent mixture A. The resulting solution is metered onto a polyester film using a no. 18 wire-wound coating rod. The functional coating is oven dried at about 50° C., resulting in a dark blue layer.

A protective top coating solution is prepared by dissolving 10 parts of polystyrene in 90 parts of toluene. The top coating solution is metered onto the dark blue layer using a no. 12 wire-wound coating rod. The top coating is oven dried at about 50° C.

The blue color of the functional coating is erased by placing the film in a storage chamber maintained at 100% relative humidity for several minutes.

Imaging of the transparent, colorless film is accomplished by placing the film in face-to-face contact with an infrared absorbing document and passing the resulting couplet through a thermal reflux copying machine, such as a Thermofax machine manufactured by 3M Company.

Using procedures similar or equivalent to that outlined above, the chromogenic materials listed in Table I, along with phloroglucinol and binder material, were formulated into solutions in a solvent mixture, the solutions were applied to a transparent film substrate and dried. The resulting functional coating was top coated with a solution of polystyrene in toluene and dried in all cases except Example No. 6. The resulting transparencies were thermally imaged (written) and erased by contact with water or water vapor.

TABLE I

| Example No. | Chromogenic Material | Binder | Written State | Erased State |
|---|---|---|---|---|
| 1 | 3,3-bis(p-dimethylaminophenyl)-6-dimethylaminophthalide(crystal violet lactone) | cellulose acetate | Blue | Colorless |
| 2 | 3,3-bis(p-dimethylaminophenyl)phthalide | cellulose acetate | Green | Colorless |
| 3 | 3,3-bis(1-ethyl-2-methylindol-3-yl)-phthalide | cellulose acetate | Red | Light Pink |
| 4 | Bis(4,4'-diethylaminophenyl)-phenyliminomethane | ethylcellulose | Orange | Light Orange |
| 5 | 4-(p-ethoxyphenylazo)-m-phenylene diamine | cellulose acetate | Orange | Yellow |
| 6 | 5',5''-dibromo-o-cresolsulfonephthalein | cellulose acetate | Red | Light Yellow |

Additional examples were prepared and tested as follows.

EXAMPLE 7

A solution of the following composition was prepared:

| Component | Parts |
|---|---|
| crystal violet lactone | 0.083 |
| phloroglucinol | 0.325 |
| Klucel 4L (Hydroxypropyl cellulose manufactured by Hercules Powder Co., Wilmington, Delaware) | 0.335 |
| Ethyl Alcohol | 16.0 |
| Toluene | 8.0 |

The solution was applied to a polyester film substrate using a #18 wire-wound coating rod. The coating was oven dried at about 50° C. To the dried functional coating was applied a top coating of 10% polystyrene in toluene which was also oven dried at about 50° C. The resulting thermally-responsive film could be alternately imaged (written) in a Thermofax machine to produce blue images and these images could be removed (erased) by passing the written film, in contact with a water-dampened cloth, through a Thermofax machine.

EXAMPLE 8

A solution of the following composition was prepared:

| Component | Parts |
|---|---|
| crystal violet lactone | 0.040 |
| phloroglucinol | 0.165 |

-continued

| Component | Parts |
|---|---|
| Acryloid B-67 (an acrylic ester resin produced by Rohm & Haas Co., Philadelphia, Pennsylvania) | 0.101 |
| 1:1 mixture by volume of toluene and ethyl alcohol | 6.0 |

The solution was applied to a glass microscope slide using a #12 wire-wound coating rod and coating was oven dried at a temperature of 50°–55° C. Upon oven drying, the functional coating became dark blue. Upon exposure of this coating to the vapors above a container of warm water, the dark blue color faded rapidly (erased). When the erased film was placed on a hot plate at 112° C., the erased film became dark blue (wrote). The erasure and writing procedures could be alternately repeated.

The series of examples to follow demonstrates that the reversibility of the color formation of various chromogenic compounds with a color developer can be used to predict eligible components for a reversibly thermally responsive transparent film. In this type of experiment a solution of a chromogenic material and a color developer is applied to a glass microscope slide and dried, resulting in a colored functional film. This film is then exposed to warm water vapor to decolorize (erase) the film. This erased film is then heated on a hot plate at about 100°–110° C. to recolor (write) the functional layer. The chromogenic compounds listed in Table II were all found to be eligible materials when formulated with phloroglucinol in a toluene/ethyl alcohol solvent mixture in a test as described above.

TABLE II

| Example No. | Chromogenic Material | Written State | Erased State |
|---|---|---|---|
| 9 | 3-(1-ethyl-2-methylindol-3-yl)-3-(4-diethylamino-2-ethoxyphenyl)phthalide | Blue | Colorless |
| 10 | A mixture of the isomers 5-(1-ethyl-2-methylindol-3-yl)-5-(4-dimethylamino-2-ethoxyphenyl)-5,7-dihydrofuro-[3,4-b]pyridin-7-one and 7-(1-ethyl-2-methylindol-3-yl)-7-(4-dimethylamino-2-ethoxyphenyl)-5,7-dihydrofuro[3,4-b]pyridin-5-one | Blue | Colorless |
| 11 | A mixture of the isomers 5-(1,2-dimethylindol-3-yl)-5-(4-dimethylaminophenyl)-5,7-dihydrofuro [3,4-b]pyridin-7-one and 7-(1,2-dimethylindol-3-yl)-7-(4-dimethylamino-phenyl)-5,7-dihydrofuro[3,4-b]pyridin-5-one | Blue | Colorless |
| 12 | 6-diethylamino-2-(N—heptanoylamino) fluoran | Red | Colorless |
| 13 | 6-diethylamino-2-butoxyfluoran | Red | Colorless |
| 14 | 2-chloro-6-diethylamino-3-methyl-fluoran | Red | Very Light Pink |
| 15 | 6-diethylamino-1,3,4-trimethylfluoran | Red | Colorless |
| 16 | 6-cyclohexylamino-2-methylfluoran | Orange | Colorless |
| 17 | 9-diethylamino-spiro[12H—benzo(a)xanthene-12,1'(3'H)isobenzofuran-3'-one] | Orange-Red | Colorless |
| 18 | 3',6'-diethylamino-spiro[1H—2-N—acetyl-isoindole-3-one-1,9'-xanthene] | Purple | Colorless |
| 19 | 3',6'-diethyl-spiro[1,2-benz-2-N—ethyl-1,1-dioxyisothiazolene-3,9-xanthene | Purple | Colorless |
| 20 | Bis(4,4'-diethylaminophenyl)ketone | Yellow | Colorless |
| 21 | N—Benzoylauramine | Green | Colorless |
| 22 | 1-(4-dimethylaminophenyl)-2-(quinolin-4-yl)ethylene | Purple | Yellow |
| 23 | 1-phenyl-1-p-dimethylaminophenyl- | Green | Colorless |

TABLE II-continued

| Example No. | Chromogenic Material | Written State | Erased State |
|---|---|---|---|
| | 6-dimethylamino-3-oxo-isochroman | | |

The series of examples to follow are presented to demonstrate that other color developer materials can be used to produce a reversibly thermally-responsive transparent film. In these examples chromogenic compound(s) were incorporated into a solution, individually or in mixtures, with binder material and gallic acid, coated on a transparent substrate and topcoated with a solution of chlorinated rubber and dried. The solvent used for these tests was a mixture substantially the same as that listed in Example 1.

TABLE III

| Example No. | Color Developer Material | Chromogenic Compound(s) | Binder Material | Written State | Erased State |
|---|---|---|---|---|---|
| 24 | Gallic Acid | crystal violet lactone | Cellulose Acetate Proprionate | Dark Blue | Color-less |
| 25 | Gallic Acid | 2-chloro-6-diethylamino-3-methyl-fluoran | Cellulose Acetate Proprionate | Dark Orange | Pale Orange |
| 27 | Gallic Acid | crystal violet lactone and 6-cyclohexyl-amino-2-methyl-fluoran | Cellulose Acetate Proprionate | Dark Blue Purple | Color-less |
| 28 | Gallic Acid | 3-(1-ethyl-2-methylindol-3-yl)-3-(4-diethyl-amino-2-butoxy-phenyl)phthalide | Cellulose Acetate | Dark Blue | Very Light Blue |

EXAMPLE 29

A solution of the following composition was prepared:

| Component | Parts |
|---|---|
| crystal violet lactone | 0.021 |
| 2',4',6'-trihydroxy-acetophenone | 0.083 |
| cellulose acetate | 0.070 |
| solvent mixture substantially the same as Example 1 | 5.7 |

The solution was coated on a transparent polyester film, dried and topcoated with a solution of polystyrene in toluene. After the topcoat was dried the film was dark blue. The film was erased to a very light blue color by exposure to warm water vapor. The erased film was then heated to about 110° C. to recolor (write) the functional layer to a dark blue.

EXAMPLE 30

A solution of the following components was prepared:

| Component | Parts |
|---|---|
| 6-diethylamino-2-dibenzylaminofluoran | 0.030 |
| phloroglucinol | 0.080 |
| cellulose acetate | 0.073 |
| solvent mixture substantially the same | 2.7 |

-continued

| Component | Parts |
|---|---|
| as Example 1 | |

The solution was coated on a transparent polyester film and dried. The functional coating was topcoated with a solution consisting of an 80:20 mixture of polystyrene and vinyl acetate resin and dried. The resulting bright green film was erased by exposure to warm water vapor or immersion in distilled water. The erased film was recolored (written) by heating to about 110° C.

The invention being thus described, it will be obvious that the same may be varied in many ways. Such variations are not to be regarded as a departure from the spirit and scope of the invention and all such modifications are intended to be included within the scope of the following claims.

What is claimed is:

1. A reversibly thermally-responsive transparent film comprising a transparent film substrate coated with a solid solution consisting essentially of:

(a) at least one chromogenic compound selected from the group consisting of:

crystal violet lactone, 3,3-bis(p-dimethylamino-phenyl)phthalide, 3,3-bis(1-ethyl-2-methylindol-3-yl)phthalide, 3-(1-ethyl-2-methylindol-3-yl)-3-(4-diethylamino-2-ethoxyphenyl)phthalide, a mixture of the isomers 5-(1-ethyl-2-methylindol-3-yl)-5-(4-dimethylamino-2-ethoxyphenyl)-5,7-dihydrofuro[3,4-b]pyridin-7-one and 7-(1-ethyl-2-methylindol-3-yl)-7-(4-diethylamino-2-ethoxy-phenyl)-5,7-dihydrofuro[3,4-b]pyridin-5-one, a mixture of the isomers 5-(1,2-dimethylindol-3-yl)-5-(4-dimethylaminophenyl)-5,7-dihydrofuro[3,4-b]pyridin-7-one and 7-(1,2-dimethylindol-3-yl)-7-(4-dimethylaminophenyl)-5,7-dihydrofuro[3,4-b]pyridin-5-one, 6-diethylamino-2-(N-heptanoylamino)fluoran, 6-diethylamino-2-butoxy-fluoran, 2-chloro-6-diethylamino-3-methyl-fluoran, 6-diethylamino-1,3,4-trimethylfluoran, 6-cyclohexylamino-2-methylfluoran, 9-diethylamino-spiro[12H-benzo(a)xanthene-12,1'(3'H)isobenzofuran-3'-one], 3',6'-diethylamino-spiro[1H-2-N-acetylisoindole-3-one-1,9'-xanthene], 3',6'-diethylamino-spiro[1,2-benz-2-N-ethyl-1,1-dioxyisothiazoline-3,9'-xanthene], bis(4,4'-diethylaminophenyl)ketone, N-Benzoylauramine, 1-(4-dimethylaminophenyl)-2-(quinolin-4-yl)ethylene, 1-phenyl-1-p-dimethylaminophenyl-6-dimethylamino-3-oxo-isochroman, bis(4,4'-diethylaminophenyl)-phenyliminomethane, 4-(p-ethoxyphenylazo)-m-phenylene diamine, 5',5''-dibromo-o-cresol-sulfonephthalein, 3-(1-ethyl-2-methylindol-3-yl)-3-(4-diethylamino-2-butoxyphenyl)phthalide and 6-diethylamino-2-dibenzylaminofluoran;

(b) at least one color developer selected from the group consisting of:

phloroglucinol, gallic acid and 2',4',6'-trihydroxyacetophenone; and (c) a suitable transparent binder therefor wherein a heat-developed image, formed by said chromogenic compound and said color developer, is stable to changes in temperature below the imaging temperature of the film.

2. The thermally-responsive transparent film of claim 1 which further comprises a protective transparent surface coating.

3. The thermally-responsive transparent film of claim 1 wherein the color developer is selected from the group consisting of phloroglucinol and gallic acid.

4. The thermally-responsive transparent film of claim 3 wherein the color developer is gallic acid.

5. The thermally-responsive transparent film of claim 4 wherein the chromogenic compound is selected from the group consisting of:

crystal violet lactone, 6-cyclohexylamino-2-methylfluoran, 2-chloro-6-diethylamino-3-methylfluoran, 6-diethylamino-1,3,4-trimethylfluoran, 3-(1-ethyl-2-methylindol-3-yl)-3-(4-diethylamino-2-butoxyphenyl)phthalide, 3,3-bis(1-ethyl-2-methylindol-3-yl)phthalide and 9-diethylamino-spiro[12H-benzo(a)xanthene-12,1'(3'H)isobenzofuran-3'-one].

6. The thermally-responsive transparent film of claim 5 wherein the chromogenic compound is crystal violet lactone.

7. The thermally-responsive transparent film of claim 6 which further includes the chromogenic compound 6-cyclohexylamino-2-methylfluoran.

8. The thermally-responsive transparent film of claim 3, wherein the color developer is phloroglucinol.

9. The thermally-responsive transparent film of claim 8 wherein the chromogenic compound is selected from the group consisting of:

crystal violet lactone, 6-diethylamino-1,3,4-trimethylfluoran, 6-diethylamino-2-dibenzylaminofluoran and a mixture of the isomers 5-(1-ethyl-2-methylindol-3-yl)-5-(4-dimethylamino-2-ethoxyphenyl)-5,7-dihydrofuro[3,4-b]pyridin-7-one and 7-(1-ethyl-2-methylindol-3-yl)-7-(4-dimethylamino-2ethoxyphenyl)-5,7-dihydrofuro[3,4-b]pyridin-5-one.

10. The thermally-responsive transparent film of claim 9 wherein the chromogenic compound is crystal violet lactone.

11. A reversibly thermally-responsive transparent film consisting essentially of a transparent polyester film substrate coated with a solid solution comprising crystal violet lactone, 1,3,5-trihydroxybenzene and cellulose acetate wherein a heat-developed image, formed by said crystal violet lactone and said 1,3,5-trihydroxybenzene, is stable to changes in temperature below the imaging temperature of the film.

12. The thermally-responsive transparent film of claim 11 which further comprises a protective polystyrene surface coating.

* * * * *